US009694892B1

(12) United States Patent
Anschuetz et al.

(10) Patent No.: US 9,694,892 B1
(45) Date of Patent: Jul. 4, 2017

(54) SYSTEM AND METHOD FOR TRIMMING TRIMMABLE MARINE DEVICES WITH RESPECT TO A MARINE VESSEL

(71) Applicant: Brunswick Corporation, Lake Forest, IL (US)

(72) Inventors: Steven M. Anschuetz, Fond du Lac, WI (US); Steven J. Andrasko, Oshkosh, WI (US); Michael J. Roth, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 15/003,335

(22) Filed: Jan. 21, 2016

Related U.S. Application Data

(60) Provisional application No. 62/272,143, filed on Dec. 29, 2015.

(51) Int. Cl.
*B63H 21/22* (2006.01)
*B63H 20/10* (2006.01)

(52) U.S. Cl.
CPC ..... *B63H 20/10* (2013.01)

(58) Field of Classification Search
CPC ..... B63H 21/22; B63H 23/00
See application file for complete search history.

(56) References Cited

U.S. PATENT DOCUMENTS 3,682,127 A 8/1972 Waquet
3,777,694 A 12/1973 Best
3,999,502 A 12/1976 Mayer
4,050,359 A 9/1977 Mayer
4,318,699 A 3/1982 Wenstadt et al.
4,413,215 A 11/1983 Cavil et al.
(Continued)

FOREIGN PATENT DOCUMENTS

EP 2368791 1/2013

OTHER PUBLICATIONS

Andrasko et al, "Systems and Methods for Providing Notification Regarding Trim Angle of a Marine Propulsion Device", Unpublished U.S. Appl. No. 14/573,200, filed Dec. 17, 2014.
(Continued)

*Primary Examiner* — Adam Tissot
*Assistant Examiner* — Alex C Dunn
(74) *Attorney, Agent, or Firm* — Andrus Intellectual Property Law, LLP

(57) ABSTRACT

A method for controlling a trim system on a marine vessel includes receiving an actual trim position of a trimmable marine device at a controller and determining a magnitude of a trim position error by comparing the actual trim position to a target trim position with the controller. The method also includes determining a magnitude of an acceleration rate of the marine vessel. The controller determines the activation time of a trim actuator coupled to and rotating the marine device with respect to the marine vessel based on the magnitude of the trim position error and the magnitude of the acceleration rate. The controller then sends a control signal to activate the trim actuator to rotate the marine device toward the target trim position. The method includes discontinuing the control signal once the activation time expires to deactivate the trim actuator. A corresponding system is also disclosed.

19 Claims, 7 Drawing Sheets

(56) References Cited

U.S. PATENT DOCUMENTS

| | | | | |
|---|---|---|---|---|
| 4,490,120 | A | 12/1984 | Hundertmark | |
| 4,565,528 | A | 1/1986 | Nakase | |
| 4,718,872 | A | 1/1988 | Olson et al. | |
| 4,749,926 | A | 6/1988 | Ontolchik | |
| 4,776,818 | A | 10/1988 | Cahoon et al. | |
| 4,824,407 | A | 4/1989 | Torigai et al. | |
| 4,836,810 | A | 6/1989 | Entringer | |
| 4,861,292 | A | 8/1989 | Griffiths et al. | |
| 4,872,857 | A | 10/1989 | Newman et al. | |
| 4,898,563 | A | 2/1990 | Torigai et al. | |
| 4,908,766 | A | 3/1990 | Takeuchi | |
| 4,931,025 | A | 6/1990 | Torigai et al. | |
| 4,939,660 | A | 7/1990 | Newman et al. | |
| 4,940,434 | A | 7/1990 | Kiesling | |
| 4,957,457 | A | 9/1990 | Probst et al. | |
| 5,113,780 | A | 5/1992 | Bennett et al. | |
| 5,118,315 | A | 6/1992 | Funami et al. | |
| 5,142,473 | A * | 8/1992 | Davis | B63B 39/14 440/1 |
| 5,171,172 | A | 12/1992 | Heaton et al. | |
| 5,263,432 | A | 11/1993 | Davis | |
| 5,352,137 | A | 10/1994 | Iwai et al. | |
| 5,366,393 | A | 11/1994 | Uenage et al. | |
| 5,385,110 | A | 1/1995 | Bennett et al. | |
| 5,474,012 | A | 12/1995 | Yamada et al. | |
| 5,474,013 | A | 12/1995 | Wittmaier | |
| 5,507,672 | A | 4/1996 | Imaeda | |
| 5,540,174 | A | 7/1996 | Kishi et al. | |
| 5,647,780 | A | 7/1997 | Hosoi | |
| 5,683,275 | A | 11/1997 | Nanami | |
| 5,707,263 | A | 1/1998 | Eick et al. | |
| 5,785,562 | A | 7/1998 | Nestvall | |
| 5,832,860 | A | 11/1998 | Lexau | |
| 5,879,209 | A | 3/1999 | Jones | |
| 6,007,391 | A | 12/1999 | Eilert | |
| 6,095,077 | A | 8/2000 | DeAgro | |
| 6,167,830 | B1 | 1/2001 | Pilger | |
| 6,273,771 | B1 | 8/2001 | Buckley et al. | |
| 6,298,824 | B1 | 10/2001 | Suhre | |
| 6,322,404 | B1 | 11/2001 | Magee et al. | |
| 6,354,237 | B1 | 3/2002 | Gaynor et al. | |
| 6,458,003 | B1 * | 10/2002 | Krueger | B63H 20/10 440/1 |
| 6,583,728 | B1 | 6/2003 | Staerzl | |
| 6,733,350 | B2 * | 5/2004 | Iida | B63H 21/22 440/84 |
| 6,745,715 | B1 | 6/2004 | Shen et al. | |
| 6,994,046 | B2 | 2/2006 | Kaji et al. | |
| 6,997,763 | B2 | 2/2006 | Kaji | |
| 7,143,363 | B1 * | 11/2006 | Gaynor | B63J 99/00 340/461 |
| 7,156,709 | B1 | 1/2007 | Staerzl et al. | |
| 7,188,581 | B1 | 3/2007 | Davis et al. | |
| 7,311,058 | B1 | 12/2007 | Brooks et al. | |
| 7,347,753 | B1 | 3/2008 | Caldwell et al. | |
| 7,389,165 | B2 | 6/2008 | Kaji | |
| 7,416,456 | B1 * | 8/2008 | Gonring | B63H 20/10 440/1 |
| 7,462,082 | B2 * | 12/2008 | Kishibata | B63H 20/10 440/1 |
| 7,530,865 | B2 | 5/2009 | Kado et al. | |
| 7,543,544 | B2 | 6/2009 | Yap | |
| 7,617,026 | B2 | 11/2009 | Gee et al. | |
| 7,641,525 | B2 | 1/2010 | Morvillo | |
| 7,942,711 | B1 | 5/2011 | Swan | |
| 7,958,837 | B1 | 6/2011 | Fraleigh | |
| 7,972,243 | B2 | 7/2011 | Kado et al. | |
| 8,011,982 | B1 | 9/2011 | Baier et al. | |
| 8,113,892 | B1 * | 2/2012 | Gable | B63H 21/21 114/144 RE |
| 8,145,370 | B2 | 3/2012 | Borrett | |
| 8,216,007 | B2 | 7/2012 | Moore | |
| 8,261,682 | B1 | 9/2012 | DeVito | |
| 8,376,791 | B2 | 2/2013 | Chiecchi | |
| 8,376,793 | B2 | 2/2013 | Chiecchi | |
| 8,388,390 | B2 * | 3/2013 | Kuriyagawa | B63H 20/10 440/1 |
| 8,428,799 | B2 | 4/2013 | Cansiani et al. | |
| 8,444,446 | B2 | 5/2013 | Kuriyagawa et al. | |
| 8,457,820 | B1 | 6/2013 | Gonring | |
| 8,480,445 | B2 | 7/2013 | Morvillo | |
| 8,583,300 | B2 * | 11/2013 | Oehlgrien | B63B 39/061 114/275 |
| 8,622,777 | B1 | 1/2014 | McNalley et al. | |
| 8,631,753 | B2 | 1/2014 | Morvillo | |
| 8,740,658 | B2 * | 6/2014 | Kuriyagawa | B63H 20/14 440/1 |
| 8,807,059 | B1 * | 8/2014 | Samples | B63H 25/42 114/144 R |
| 8,855,890 | B2 * | 10/2014 | Egle | B64D 31/04 123/399 |
| 8,858,278 | B2 | 10/2014 | Morvillo | |
| 9,052,717 | B1 * | 6/2015 | Walser | B60W 10/06 |
| 9,068,855 | B1 | 6/2015 | Guglielmo | |
| 9,278,740 | B1 | 3/2016 | Andrasko et al. | |
| 9,290,252 | B1 * | 3/2016 | Tuchscherer | B63H 20/08 |
| 9,381,989 | B1 * | 7/2016 | Poirier | B63H 5/125 |
| 2003/0013359 | A1 * | 1/2003 | Suganuma | B63H 20/00 440/77 |
| 2005/0245147 | A1 * | 11/2005 | Takada | B63H 21/213 440/84 |
| 2007/0089660 | A1 * | 4/2007 | Bradley | B63H 25/42 114/144 A |
| 2011/0263167 | A1 | 10/2011 | Chiecchi | |
| 2013/0312651 | A1 | 11/2013 | Gai | |
| 2013/0340667 | A1 | 12/2013 | Morvillo | |
| 2014/0209007 | A1 | 7/2014 | Morvillo | |
| 2014/0224166 | A1 | 8/2014 | Morvillo | |
| 2014/0295717 | A1 | 10/2014 | Kuriyagawa et al. | |
| 2016/0068247 | A1 * | 3/2016 | Morvillo | B63H 20/08 701/21 |

OTHER PUBLICATIONS

Andrasko et al, "System and Method for Controlling Attitude of a Marine Vessel Having Trim Tabs", Unpublished U.S. Appl. No. 14/472,565, filed Aug. 29, 2014.

Andrasko et al, "Systems and Methods for Controlling Movement of Drive Units on a Marine Vessel", Unpublished U.S. Appl. No. 14/177,762, filed Feb. 11, 2014.

Mercury Marine, 90-8M0081623 JPO Owners Manual—Auto Trim Portion, Section 2—on the Water, May 2013, p. 21.

Mercury Marine, 90-8M0076286 JPO Service Manual—Auto Trim Portion, Theory of Operation, Jul. 2013, p. 2A-5.

Andrasko et al., "Systems and Methods for Automatically Controlling Attitude of a Marine Vessel with Trim Devices," Unpublished U.S. Appl. No. 14/873,803, filed Oct. 2, 2015.

Mercury Marine, SmartCraft Manual, p. 2A-5, 2013.

Mercury Marine, SmartCraft Manual, p. 21, 2013.

* cited by examiner

74
| TRIM UP PULSE LENGTH | | | | | | |
|---|---|---|---|---|---|---|
| ERROR (%) | 0 | 2 | 4 | 6 | 8 | 10 |
| TIME (SEC) | -- | -- | A | -- | -- | -- |
FIG. 5
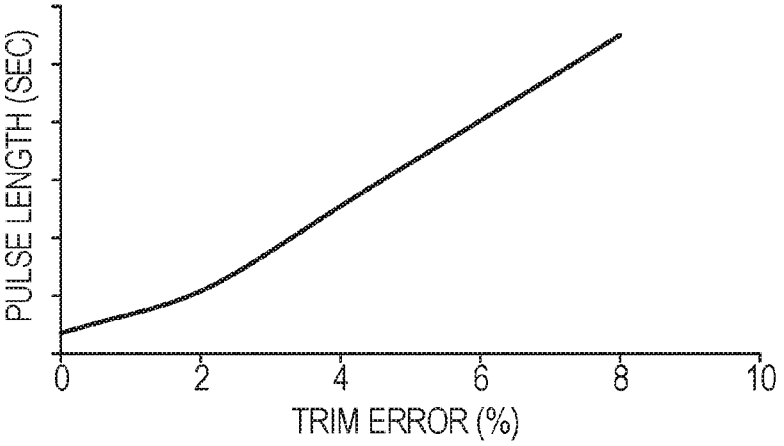
FIG. 6
76
| TRIM DOWN PULSE LENGTH | | | | | | |
|---|---|---|---|---|---|---|
| ERROR (%) | -10 | -8 | -6 | -4 | -2 | 0 |
| TIME (SEC) | -- | -- | B | C | -- | -- |
FIG. 7
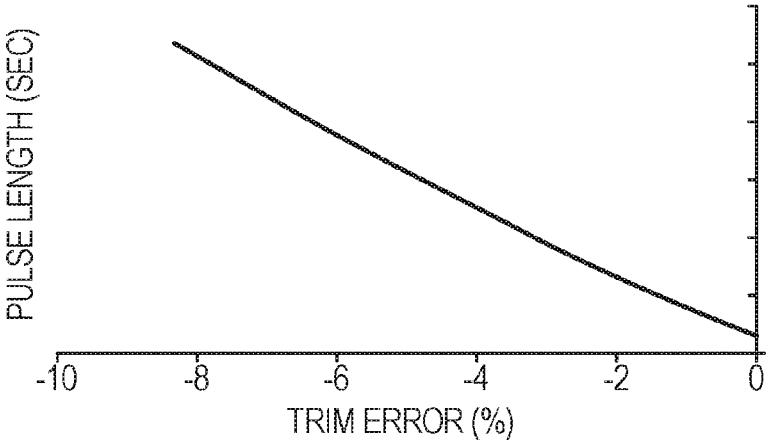
FIG. 8

78
| TRIM UP PULSE LENGTH MULTIPLIER | | | | | |
|---|---|---|---|---|---|
| ACCELERATION RATE | -500 | -300 | 0 | 300 | 500 |
| MULTIPLIER | -- | -- | D | -- | -- |
FIG. 9
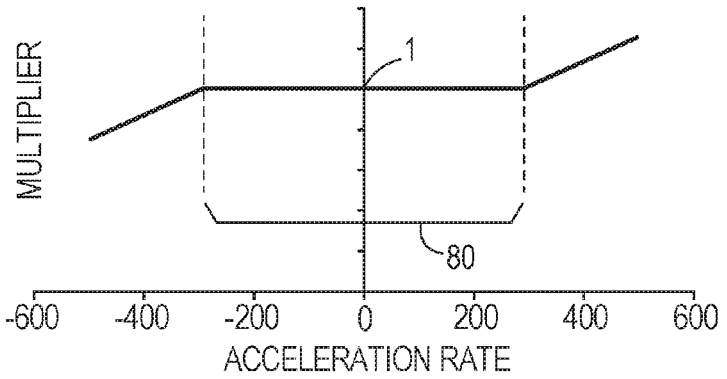
FIG. 10
82
| TRIM DOWN PULSE LENGTH MULTIPLIER | | | | | |
|---|---|---|---|---|---|
| ACCELERATION RATE | -500 | -300 | 0 | 300 | 500 |
| MULTIPLIER | -- | -- | -- | E | -- |
FIG. 11
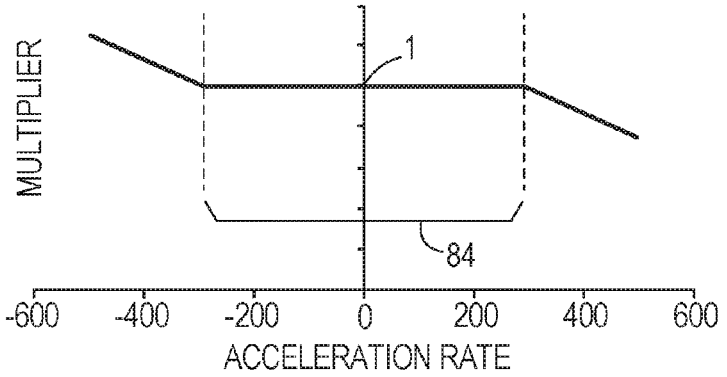
FIG. 12

SYSTEM AND METHOD FOR TRIMMING TRIMMABLE MARINE DEVICES WITH RESPECT TO A MARINE VESSEL

CROSS-REFERENCE TO RELATED APPLICATION

The present application claims the benefit of U.S. Provisional Application Ser. No. 62/272,143, filed Dec. 29, 2015, which is hereby incorporated by reference.

FIELD

The present disclosure relates to systems and methods for trimming trimmable marine devices with respect to a transom of a marine vessel.

BACKGROUND

U.S. Pat. No. 4,318,699, incorporated by reference herein, discloses a sensor that responds to the operation of a marine transportation system to sense on-plane and off-plane conditions of a boat to operate a trim control to automatically position a trimmable drive for a desired boating operation. The preferred embodiment senses engine speed while an alternative embodiment senses fluid pressure opposing boat movement. The drive is moved to an auto-out position at high speeds and to a trimmed-in position at lower speeds.

U.S. Pat. No. 4,490,120, incorporated by reference herein, discloses A hydraulic system for trimming and tilting an outboard propulsion unit, which includes both trim piston-cylinder units and a trim-tilt piston-cylinder unit. The flow of hydraulic fluid from the reversible pump is controlled by a spool valve. A pressure relief valve is mounted in the spool to maintain pressure on one side of the spool when the pump is turned off to rapidly close the return valve and prevent further movement of the piston-cylinder units.

U.S. Pat. No. 4,861,292, incorporated by reference herein, discloses a system for optimizing the speed of a boat at a particular throttle setting that utilizes sensed speed changes to vary the boat drive unit position vertically and to vary the drive unit trim position. The measurement of boat speed before and after an incremental change in vertical position or trim is used in conjunction with a selected minimum speed change increment to effect subsequent alternate control strategies. Depending on the relative difference in before and after speeds, the system will automatically continue incremental movement of the drive unit in the same direction, hold the drive unit in its present position, or move the drive unit an incremental amount in the opposite direction to its previous position. The alternate control strategies minimize the effects of initial incremental movement in the wrong direction, eliminate excessive position hunting by the system, and minimize drive unit repositioning which has little or no practical effect on speed.

U.S. Pat. No. 6,007,391, incorporated by reference herein, discloses an automatically adjustable trim system for a marine propulsion system that provides automatic trimming of the propeller in response to increased loads on the propeller. A propulsion unit is attached to a boat transom through a tilt mechanism including a transom bracket and a swivel bracket. In a first embodiment, the transom bracket is clamped to a flexible transom which flexes in response to forces exerted on the transom during acceleration. In a second embodiment, the transom bracket is clamped to a transom bracket mounting platform that is generally parallel to and pivotally attached to the transom. A trim angle biasing mechanism is mounted between the transom and the transom bracket mounting platform for automatically adjusting the trim angle. A third embodiment includes a trim angle biasing mechanism incorporated into the transom bracket or swivel bracket. A fourth embodiment includes a spring-loaded pawl assembly between the swivel bracket and transom bracket.

U.S. Pat. No. 7,347,753, incorporated by reference herein, discloses a hydraulic system for a sterndrive marine propulsion device that directs the flow of hydraulic fluid through the body and peripheral components of a gimbal ring in order to reduce the number and length of flexible hydraulic conduits necessary to conduct pressurized hydraulic fluid from a pump to one or more hydraulic cylinders used to control the trim or tilt of a marine drive unit relative to a gimbal housing.

U.S. Pat. No. 7,416,456, incorporated by reference herein, discloses an automatic trim control system that changes the trim angle of a marine propulsion device as a function of the speed of the marine vessel relative to the water in which it is operated. The changing of the trim angle occurs between first and second speed magnitudes which operate as minimum and maximum speed thresholds.

U.S. Pat. No. 8,457,820, incorporated by reference herein, discloses a method for controlling the operation of a marine vessel subject to porpoising. The method includes sensing an operational characteristic of the marine vessel which is indicative of porpoising of the marine vessel, and responding to the sensing of the operational characteristic with a response that is representative of the operational characteristic of the marine vessel as being indicative of the porpoising of the marine vessel.

Unpublished U.S. patent application Ser. No. 14/873,803, filed Oct. 2, 2015, and assigned to the Applicant of the present application, which is incorporated by reference herein, discloses systems and methods for controlling position of a trimmable drive unit with respect to a marine vessel. A controller determines a target trim position as a function of vessel or engine speed. An actual trim position is measured and compared to the target trim position. The controller sends a control signal to a trim actuator to trim the drive unit toward the target trim position if the actual trim position is not equal to the target trim position and if at least one of the following is true: a defined dwell time has elapsed since a previous control signal was sent to the trim actuator to trim the drive unit; a given number of previous control signals has not been exceeded in an attempt to achieve the target trim position; and a difference between the target trim position and the actual trim position is outside of a given deadband. The method may include sending a second control signal for a defined brake time to trim the drive unit in an opposite, second direction in response to a determination that the actual trim position has one of achieved and exceeded the target trim position.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one example of the present disclosure, a method for controlling a trim system on a marine vessel includes receiving an actual trim position of a trimmable marine device at a controller and determining a magnitude of a trim position error by comparing the actual trim position to a target trim position with the controller. The method also includes determining a magnitude of an acceleration rate of the marine vessel. The controller determines the activation time of a trim actuator coupled to and rotating the marine device with respect to the marine vessel based on the magnitude of the trim position error and the magnitude of the acceleration rate. The controller then sends a control signal to activate the trim actuator to rotate the marine device toward the target trim position. The method includes discontinuing the control signal once the activation time expires so as to deactivate the trim actuator.

According to another example of the present disclosure, a system for controlling a trim position of a trimmable marine device with respect to a marine vessel includes a controller that determines a target trim position of the marine device based on a condition of the marine vessel. A trim position sensor senses an actual trim position of the marine device and sends actual trim position information to the controller. A trim actuator is coupled to the marine device and is configured to rotate the marine device about a horizontal trim axis in response to signals from the controller. The controller determines a magnitude of a trim position error by comparing the actual trim position to the target trim position. The controller also determines an activation time of the trim actuator based on the magnitude of the trim position error. The controller then sends a control signal to the trim actuator to rotate the marine device toward the target trim position and discontinues the control signal once the activation time expires.

BRIEF DESCRIPTION OF THE DRAWINGS

The present disclosure is described with reference to the following Figures. The same numbers are used throughout the Figures to reference like features and like components.

FIG. 5 illustrates one example of a look-up table that can be used to calculate a raw on-time for a trim actuator during a trim-up event.

FIG. 6 illustrates one example of a relationship between trim errors and raw on-times during trim-up events.

FIG. 7 illustrates one example of a look-up table that can be used to calculate a raw on-time for a trim actuator during a trim-down event.

FIG. 8 illustrates one example of a relationship between trim errors and raw on-times during trim-down events.

FIG. 9 illustrates one example of a look-up table that can be used to determine an on-time multiplier during a trim-up event.

FIG. 10 illustrates one example of a relationship between acceleration rates and on-time multipliers during trim-up events.

FIG. 11 illustrates one example of a look-up table that can be used to determine an on-time multiplier during a trim-down event.

FIG. 12 illustrates one example of a relationship between acceleration rates and on-time multipliers during trim-down events.

DETAILED DESCRIPTION

Figure 1:
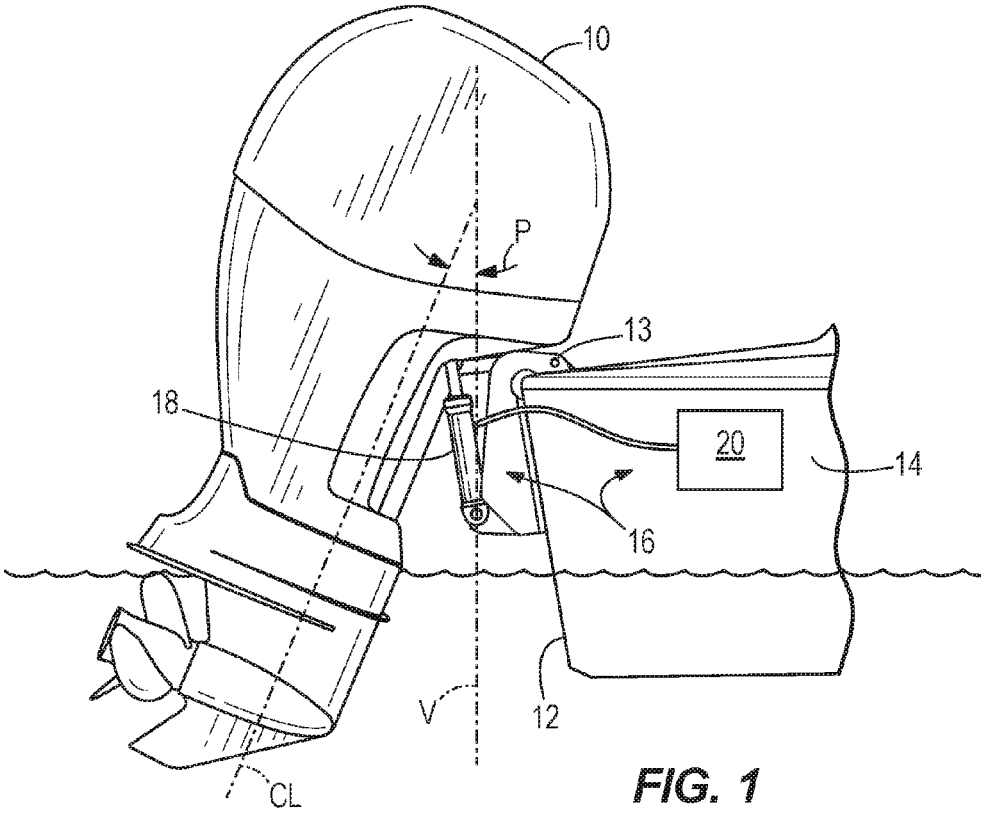
FIG. 1 illustrates one example of a trimmable marine device according to the present disclosure.

In the present description, certain terms have been used for brevity, clarity and understanding. No unnecessary limitations are to be inferred therefrom beyond the requirement of the prior art because such terms are used for descriptive purposes only and are intended to be broadly construed.

The present disclosure relates to systems and methods for controlling one or more trim actuators on a marine vessel so as to control a relative position of a trimmable marine device with respect to the marine vessel. In one example, the trim actuator is a hydraulic piston-cylinder assembly in fluid communication with a hydraulic pump-motor combination, although the principles of some of the below examples could apply equally to electric linear actuators, pneumatic actuators, or other types of trim devices. The trim actuator may be actuated between an extended position and a retracted position by provision of hydraulic fluid, electrical power, pneumatic fluid, etc. The extension and retraction of the trim actuator can be used to rotate a trimmable marine device up and down with respect to a marine vessel to which it is coupled. Examples of such a trimmable marine device include, but are not limited to: trim tabs, trim deflectors, trim interceptors, and/or marine propulsion devices such as outboard motors or lower units of stern drives.

Those skilled in the art of marine vessel propulsion and control are familiar with many different ways in which the trim angle of a marine device such as an outboard motor or stern drive can be varied to change the handling or fuel efficiency of the vessel. For example, many manual trim control systems are known to those skilled in the art. In typical operation, the operator of a marine vessel can change the trim angle of an associated outboard motor as the velocity of the vessel changes. This is done to maintain an appropriate angle of the vessel with respect to the water as it achieves a planing speed and as it increases its velocity over the water while on plane. The operator inputs a command to change the trim angle for example by using a keypad, button, or similar input device with "trim up" and "trim down" input choices.

The systems of the present disclosure are also capable of carrying out automatic trim (auto-trim) methods, in which the marine device is automatically trimmed up or down with respect to its current position, depending on a desired attitude of the marine vessel with respect to vessel speed. Auto-trim systems perform trim operations automatically, as a function of vessel speed, without requiring intervention by the operator of the marine vessel. The automatic change in trim angle of the trimmable marine device enhances the operation of the marine vessel as it achieves planing speed and as it further increases its velocity over the water while on plane. For example, trimming the marine device can affect a direction of thrust of a propeller with respect to a vessel transom, as well as affect vessel roll and pitch.

Referring to FIG. 1, the position of a trimmable marine device 10 (such as the outboard motor shown herein) with respect to the transom 12 of a marine vessel 14 is controlled by a trim actuator 16. The trim actuator 16 may comprise a hydraulic piston-cylinder assembly 18 connected to a hydraulic pump-motor combination 20. The piston-cylinder assembly 18 has a first end (here, the cylinder end) coupled to the transom 12 of the vessel 14 and a second, opposite end (here, the rod end) coupled to the marine device 10, as known to those having ordinary skill in the art. The piston-cylinder assembly 18 operates to rotate the marine device 10 about a horizontal trim axis 13 to a trimmed-out position, to a trimmed-in position, or to maintain the marine device 10 in any position there between as the pump-motor combination 20 provides hydraulic fluid to the piston-cylinder assembly 18 to move the piston within the cylinder. As mentioned, however, other types of hydro-mechanical or electro-mechanical actuators could be used in other examples.

Figure 2:
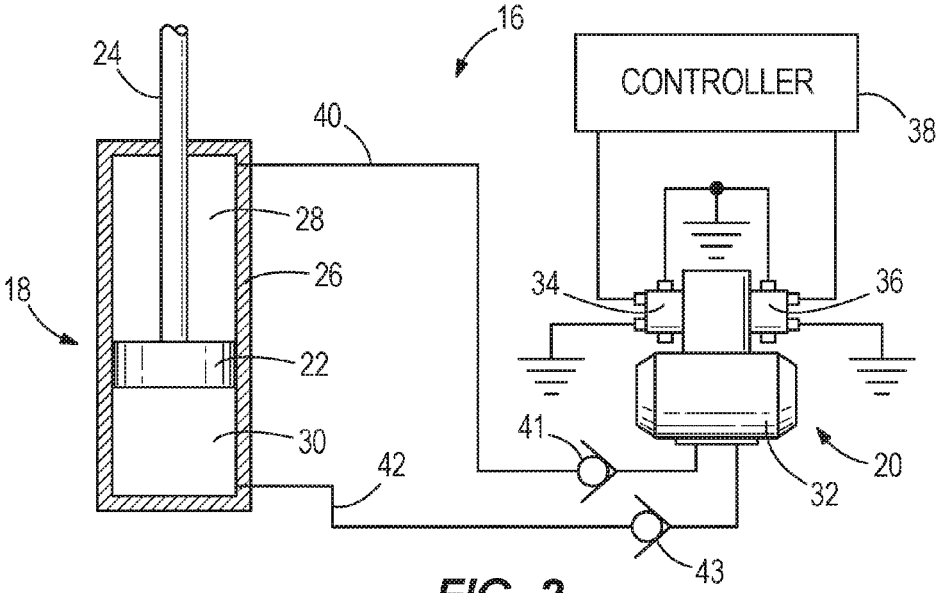
FIG. 2 illustrates a schematic of a trim actuator according to the present disclosure.

One example of a hydraulic trim actuator 16 is shown in FIG. 2. The piston-cylinder assembly 18 is shown schematically as having a piston 22 connected to a rod 24 disposed in a cylinder 26. The piston 22 defines a first chamber 28 within the cylinder 26 and a second chamber 30 within the cylinder 26, both of which chambers 28, 30 change in size as the piston 22 moves within the cylinder 26. The pump-motor combination 20 includes a pump-motor 32 connected to a trim-in relay 34 and a trim-out relay 36. In other examples, the trim-in relay 34 and the trim-out relay 36 are a single relay that can turn the pump-motor 32 on or off and can effect a trim-in or trim-out movement of the trim actuator 16. The relays 34 and 36 are connected to a controller 38 that controls energizing of solenoids in the relays 34 and 36, which act as switches to couple a power source such as a battery (not shown) to chamber 28 of the piston-cylinder assembly 18, and a second hydraulic line 42 couples the pump-motor 32 to the second chamber 30 of the piston-cylinder assembly 18. As long as the trim-in relay 34 is activated, the pump-motor 32 provides hydraulic fluid through the first hydraulic line 40 to the first chamber 28 of the piston-cylinder assembly 18, thereby pushing the piston 22 downwardly within the cylinder 26 and lowering (trimming in) the marine device 10 coupled to the rod 24. As long as the trim-out relay 36 is activated, the pump-motor 32 provides hydraulic fluid through the second hydraulic line 42 to the second chamber 30 of the piston-cylinder assembly 18, thereby pushing the piston 22 upwardly within the cylinder 26 and raising (trimming out) the marine device 10 coupled to the rod 24. Hydraulic fluid can be removed from the opposite chamber 28 or 30 of the cylinder 26 into which fluid is not being pumped in either instance, and drained to a tank or circulated through the pump-motor 32.

In this way, the trim actuator 16 can position the marine device 10 at different angles with respect to the transom 12. These may be a neutral (level) trim position, in which the marine device 10 is in more or less of a vertical position; a trimmed in (trimmed down) position; or a trimmed out (trimmed up) position. A trimmed out position, as shown in FIG. 1, is often used when the marine vessel is on plane and high speeds are required. At high speeds, the trimmed out position causes the bow of the marine vessel 14 to rise out of the water, resulting in better handling and increased fuel efficiency. Thus, many auto-trim algorithms include determining a target trim position at which to orient the marine device 10 with the controller 38 based on vessel speed. In other examples, the target trim position may be based on other vessel conditions, such as but not limited to engine speed, a combination of vessel speed and engine speed, or a tradeoff between vessel speed and engine speed depending on additional vessel conditions. The controller 38 may define the target trim position by reference to a vertical line V. When the centerline CL of the marine device 10 is parallel to the vertical line V, the controller 38 may consider this to be zero trim. Non-zero trim can be quantified as a value P, which represents the angle between the centerline CL of the marine device 10 and the vertical line V. This value P can be expressed as an angle, a percentage of a total angle to which the marine device 10 can be trimmed, a scalar value, a polar coordinate, or any other appropriate unit. For purposes of the description provided herein below, the angle P will be expressed as a percentage of total allowable trim angle, which can be measured from vertical, from a fully trimmed-out position, or from a fully-trimmed in position.

Figure 3:
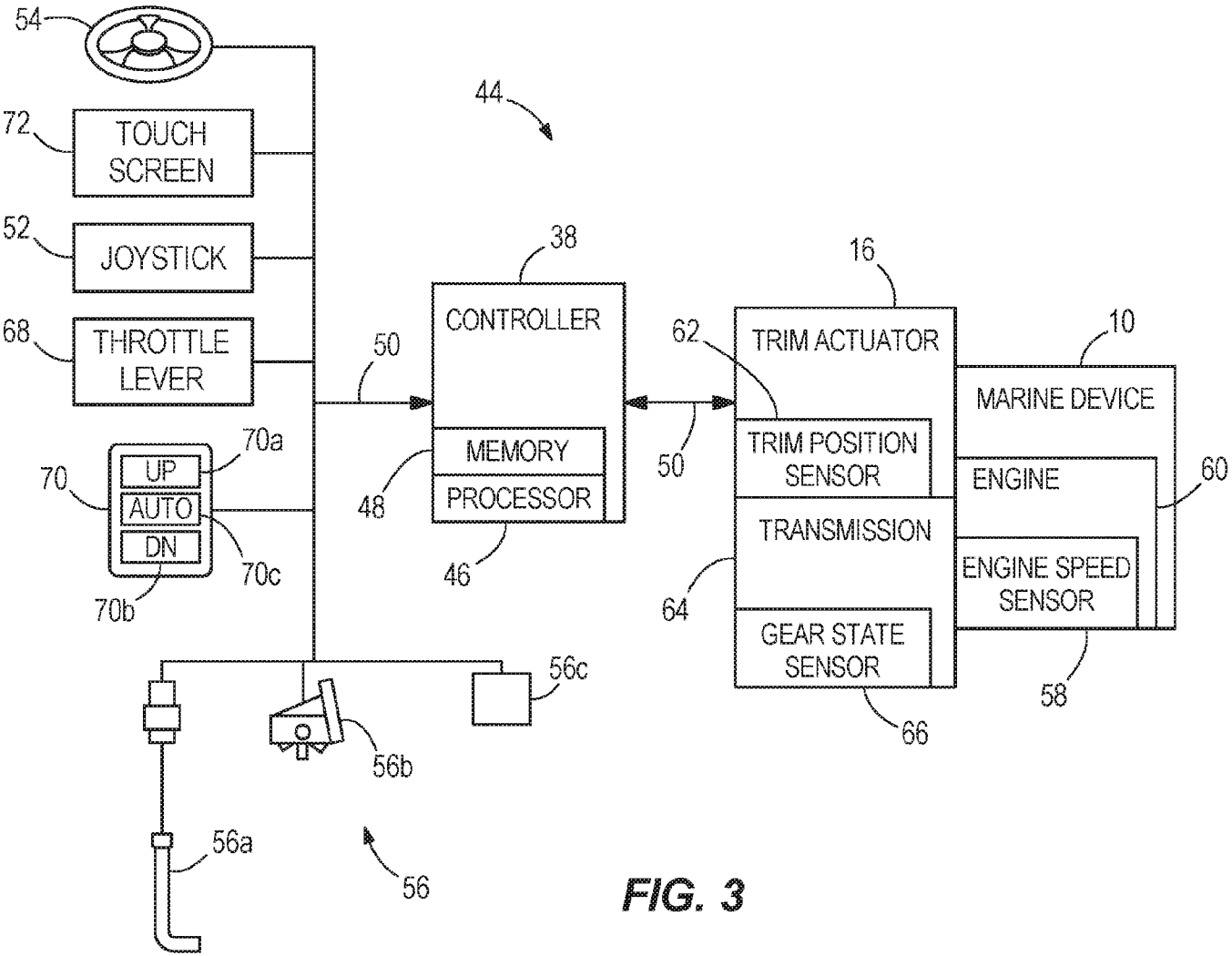
FIG. 3 illustrates a control system according to one example of the present disclosure.

FIG. 3 shows a schematic of a system 44 associated with the marine vessel 14 of FIG. 1. In the example shown, the system 44 includes the controller 38, which is programmable and includes a processor 46 and a memory 48. The controller 38 can be located anywhere in the system 44 and/or located remote from the system 44 and can communicate with various components of the marine vessel 14 via wired and/or wireless links, as will be explained further herein below. Although FIG. 3 shows a single controller 38, the system 44 can include more than one controller 38. For example, the system 44 can have a controller 38 located at or near a helm of the marine vessel 14 and can also have one or more controllers located at or near the marine device 10. Portions of the method disclosed herein below can be carried out by a single controller or by several separate controllers. Each controller 38 can have one or more control sections or control units. One having ordinary skill in the art will recognize that the controller 38 can have many different forms and is not limited to the example that is shown and described. For example, here the controller 38 carries out the trim control method for the entire system 44, but in other examples separate trim control units and propulsion control units could be provided.

In some examples, the controller 38 may include a computing system that includes a processing system, storage system, software, and input/output (I/O) interfaces for communicating with devices such as those shown in FIG. 3, and about to be described herein. The processing system loads and executes software from the storage system, such as software programmed with a trim control method. When executed by the computing system, trim control software directs the processing system to operate as described herein below in further detail to execute the trim control method. The computing system may include one or many application modules and one or more processors, which may be communicatively connected. The processing system can comprise a microprocessor (e.g., processor 46) and other circuitry that retrieves and executes software from the storage system. Processing system can be implemented within a single processing device but can also be distributed across multiple processing devices or sub-systems that cooperate in existing program instructions. Non-limiting examples of the processing system include general purpose central processing units, applications specific processors, and logic devices.

The storage system (e.g., memory 48) can comprise any storage media readable by the processing system and capable of storing software. The storage system can include volatile and non-volatile, removable and non-removable media implemented in any method or technology for storage of information, such as computer readable instructions, data structures, program modules, or other data. The storage system can be implemented as a single storage device or across multiple storage devices or sub-systems. The storage system can further include additional elements, such as a controller capable of communicating with the processing system. Non-limiting examples of storage media include random access memory, read only memory, magnetic discs, optical discs, flash memory, virtual memory, and non-virtual memory, magnetic sets, magnetic tape, magnetic disc storage or other magnetic storage devices, or any other medium which can be used to store the desired information and that may be accessed by an instruction execution system. The storage media can be a non-transitory or a transitory storage media.

In this example, the controller 38 communicates with one or more components of the system 44 via a communication link 50, which can be a wired or wireless link. The controller 38 is capable of monitoring and controlling one or more operational characteristics of the system 44 and its various subsystems by sending and receiving control signals via the communication link 50. In one example, the communication link 50 is a controller area network (CAN) bus, but other types of links could be used. It should be noted that the extent of connections of the communication link 50 shown herein is for schematic purposes only, and the communication link 50 in fact provides communication between the controller 38 and each of the sensors, devices, etc. described herein, although not every connection is shown in the drawing for purposes of clarity.

As mentioned, the controller 38 receives inputs from several different sensors and/or input devices aboard or coupled to the marine vessel 14. For example, the controller 38 receives a steering input from a joystick 52 and/or a steering wheel 54. The controller 38 is provided with an input from a vessel speed sensor 56. The vessel speed sensor 56 may be, for example, a pitot tube sensor 56*a*, a paddle wheel type sensor 56*b*, or any other speed sensor appropriate for sensing the actual speed of the marine vessel. The vessel speed may instead be obtained by taking readings from a GPS device 56*c*, which calculates speed by determining how far the vessel 14 has traveled in a given amount of time. The marine device 10 is provided with an engine speed sensor 58, such as but not limited to a tachometer, that determines a speed of the engine 60 powering the marine device 10 in rotations per minute (RPM). The engine speed can be used along with other measured or known values to approximate a vessel speed (i.e., to calculate a pseudo vessel speed). A trim position sensor 62 is also provided for sensing an actual position of the trim actuator 16, for example, by measuring a relative position between two parts associated with the trim actuator 16. The trim position sensor 62 may be any type of sensor known to those having ordinary skill in the art, for example a Hall effect sensor or a potentiometer. A transmission 64 and gear state sensor 66 can also be provided for the marine device 10. FIG. 3 shows an instance in which the marine device 10 is an outboard motor, but in the instance that the marine device 10 is, for example, a stern drive or a trim tab, the transmission, engine, and their associated components would not be coupled to the trim actuator 16 as shown herein.

Other inputs to the system 44 can come from operator input devices such as a throttle lever 68, a keypad 70, and a touchscreen 72. The throttle lever 68 allows the operator of the marine vessel to choose to operate the vessel in neutral, forward, or reverse, as is known. The keypad 70 can be used to initiate or exit any number of control or operation modes (such as auto-trim mode), or to make selections while operating within one of the selected modes. In one example, the keypad 70 comprises an interface having a "trim up" button 70*a*, a "trim down" button 70*b*, and an "auto-trim on/resume" button 70*c*. The touchscreen 72 can also be used to initiate or exit any number of control or operation modes (such as trim up, trim down, or auto-trim mode), and in that case the inputs can be buttons in the traditional sense or selectable screen icons. The touchscreen 72 can also display information about the system 44 to the operator of the vessel, such as engine speed, vessel speed, trim angle, trim operating mode, vessel acceleration rate, etc.

One issue with many auto-trim systems is that trim actuators 16 are often controlled according to discrete steps and are thus actuated to be either on or off. Generally, when a relay (such as trim-in relay 34 or trim-out relay 36, FIG. 2) is energized for a specific amount of time in order to activate the trim actuator 16, the system will either overshoot or undershoot the target trim position by a small amount due to inertia of the trim pump-motor 32, time required for pump check valves (see 41, 43, FIG. 2) to fully close, expansion of the hydraulic lines 40, 42, length of the hydraulic lines, etc. This makes it difficult to hit an exact trim position. Other issues that may contribute to the inaccuracy of some trim positions is that some trim position sensors 62 have a bowtie configuration instead of a Hall effect, which bowtie configuration has production tolerances and/or slop. Thus, a trim control system 44 that uses a closed-loop method (wherein the relays 34, 36 are de-energized once the trim position sensor 62 senses that the actual position of the trimmable marine device 10 is equal to a target position) will often result in coasting of the trim actuator 16 beyond the target position, which coasting is caused by the above-mentioned overshoot and undershoot factors.

Figure 4:
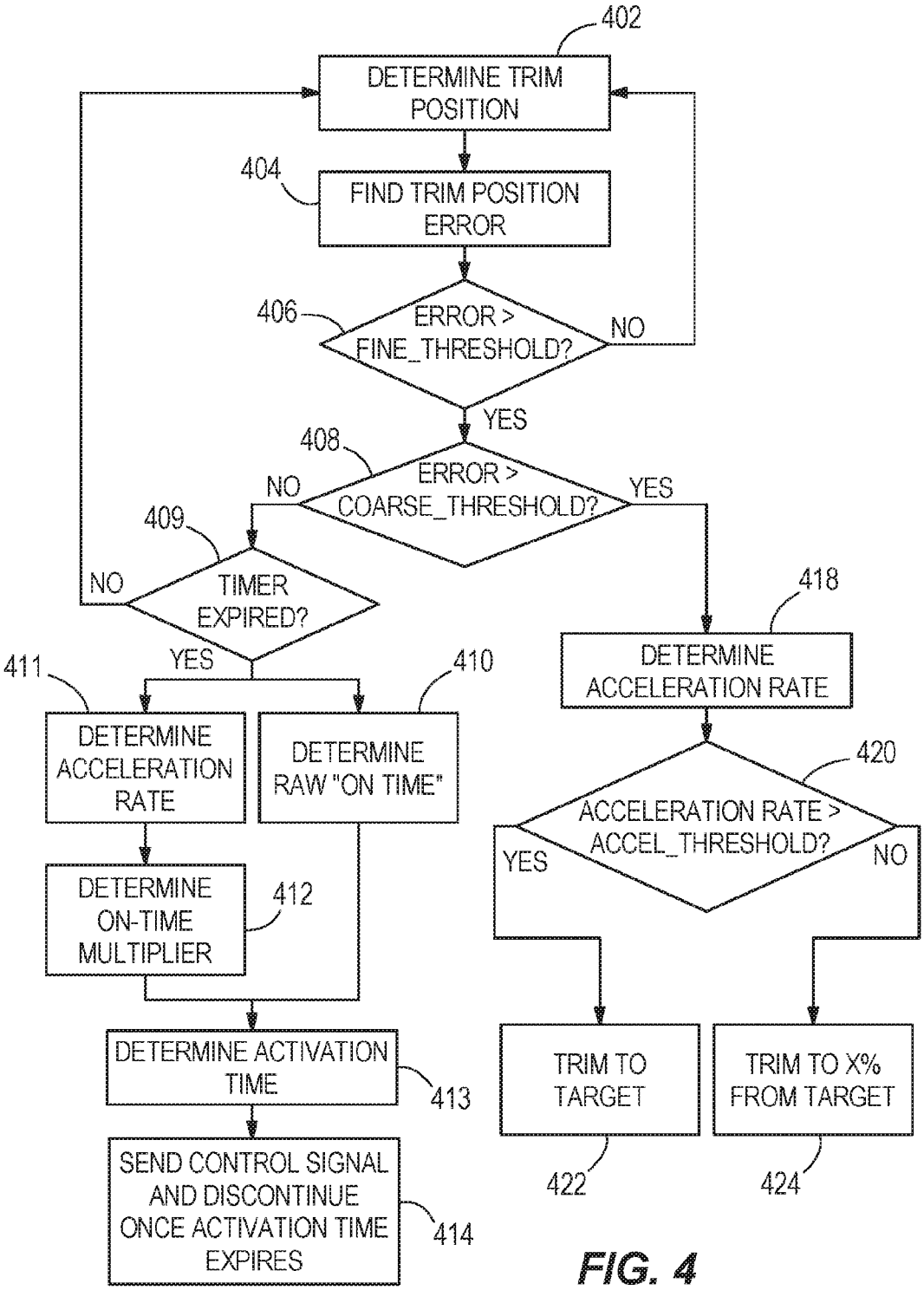
FIG. 4 shows a method according to one example of the present disclosure.

A method for controlling a trim system on a marine vessel 14 according to the present disclosure is shown in FIG. 4. As shown at 402, the method begins by determining a trim position of the trimmable marine device 10, such as with trim position sensor 62. The actual trim position of the trimmable marine device 10 is received at the controller 38. The controller 38 then determines a magnitude of the trim position error by comparing the actual trim position to a target trim position, as shown at 404 (e.g., by subtracting one from the other). The method next includes determining if the magnitude of the error exceeds a first error threshold, herein referred to as a "fine threshold," as shown at 406. If YES, the method may also include comparing the magnitude of the trim position error to a second error threshold ("coarse threshold"), as shown at 408. Depending on the determinations made in boxes 402 to 408, the method may next continue to box 409 or box 418. The method of boxes 418 to 424 is the subject of Applicant's co-pending Provisional Application Ser. No. 62/272,140, filed Dec. 29, 2015, incorporated by reference herein, and will not be described further herein. The method of boxes 409 to 414 is the subject of the present application, and will be described further herein below. It should be noted that the present method may skip box 406 and may proceed directly from box 404 to box 408. Alternatively, the method may skip both boxes 406 and 408 and may proceed directly from box 404 to box 409. In other examples, some of the steps in the boxes may be carried out simultaneously or in a different order than that shown herein. Thus, unless logic dictates otherwise, the order of the boxes shown herein is not limiting on the scope of the present claims.

In the event that step 406 is present, it provides a way to ensure that the trim system is only correcting trim position errors that are significant enough to have an affect on the handling of the vessel 14, or large enough that the trim actuator 16 is able to move a small enough amount to correct them. If the determination at box 406 is NO, then the method returns to box 402, and will cycle until a trim position error having a magnitude greater than the first error threshold accumulates. In the event step 408 is included, it provides a way to distinguish between a relatively large trim error and a relatively small trim error. The method of the present disclosure works best for correcting small (fine) errors, as it does not rely on feedback from the trim position sensor 62 to work, but rather uses open loop control over the trim system. Therefore, the method of the present disclosure may include comparing the magnitude of the trim position error to a first error threshold with the controller 38 (box 406), and sending a control signal to activate the trim actuator 16 only if the magnitude of the trim position error exceeds the first (fine) error threshold. The method may also include comparing the magnitude of the trim position error to a second (coarse) error threshold having a greater magnitude than the first error threshold with the controller 38 (box 408), and sending a control signal to activate the trim actuator 16 only if the magnitude of the trim position error is less than the second error threshold. In one example, the first error threshold is 2.5% and the second error threshold is 4.0%.

As shown in box 409, the method described herein also includes determining whether a given period of time has elapsed since the trim actuator 16 was last activated. This is an optional step that may be used for adjustment of fine errors, because it is inefficient to continually correct small errors without waiting to see if a previous correction is still having a coasting effect on the trim position of the marine device 10. Note that the method of boxes 418 to 424 does not include determining whether the timer has expired since a previous correction; rather, corrections are made for coarse (large) errors immediately after they are detected regardless of the timer. Returning to the present method, if the timer step is included, and the timer has not expired (NO at box 409), the method returns to box 402 and re-determines the trim position. In another example, the method might include first waiting for the timer to expire, and after that determining if the trim position error is one that requires correction (see box 406).

If the timer has expired, as shown at box 410, the method includes calculating a raw on-time based on the magnitude of the trim position error. This step can also take into account the sign of the trim position error, and will be described further herein below. As shown in box 411, the method also includes determining a magnitude of an acceleration rate of the marine vessel 14. This may be done by the controller 38 calculating a change in the velocity of the vessel 14 over time, or may be calculated by a program contained within the GPS device 56*c* and subsequently provided to the controller 38. In yet another example, the acceleration rate can be measured directly from an attitude heading reference sensor (AHRS), which measures via an accelerometer rather than by calculating change in speed over change in time. In any case, the acceleration rate has a magnitude (for example, in meters per second squared) and a sign (such as negative for deceleration and positive for acceleration). At box 412, the method includes determining an on-time multiplier based on the magnitude (and in some examples the sign) of the acceleration rate, as will also be described more fully herein below. Note that steps 410, 411, and 412 can be performed somewhat simultaneously, as shown, or can be preformed in succession in various orders.

Then at box 413, the controller 38 multiplies the raw on-time by the on-time multiplier to determine the activation time of the trim actuator 16. Thus, the controller 38 ultimately determines the activation time of the trim actuator 16 coupled to and rotating the marine device 10 with respect to the marine vessel 14 based on the magnitude of the trim position error (factored in at box 410) and the magnitude of the acceleration rate (factored in at box 412).

As shown at box 414, the method then includes sending a control signal with the controller 38 to activate the trim actuator 16 to rotate the marine device 10 toward the target trim position and then discontinuing the control signal once the activation time expires to deactivate the trim actuator 16. In one example, sending the control signal to activate the trim actuator 16 comprises providing electricity through a trim relay (34 or 36) for the activation time. The control signal is discontinued once the activation time expires by discontinuing the flow of electricity through the relay's coil.

FIGS. 5-8 will be used to provide more description of the step in box 410. FIG. 5 shows an exemplary look-up table 74 to be used when the trim position error is positive (i.e., target minus actual is positive) and the marine device 10 needs to be trimmed up to reach the target. It should be noted that the sign convention of the error is not limiting on the scope of the present disclosure, and that the present disclosure also covers methods in which the sign convention is reversed, with corresponding reverse judgments being made by the controller. This is apparent from the error values in the look-up table 74 being positive values. Each error input returns a calibrated raw on-time that the trim-out relay 36 needs to be activated in order to correct the error and achieve the target trim position. For example, with a trim position error of 4%, the raw on-time for the trim-out relay 36 is A seconds. Note that the expression of error in percentages and of time in seconds is merely exemplary, and other units could be used. Additionally, a look-up table 74 need not be used. Instead, any type of input-output map that relates a plurality of trim position errors to a plurality of calibrated on-times could be used to determine a raw on-time and eventually calculate the activation time. Because the calibrated on-times will vary from system to system, the precise values are not shown herein. However, FIG. 6 shows how the raw on-time increases as the magnitude of the trim position error increases. Note that the curve shown in FIG. 6 is merely exemplary, and the relationship shown could instead have a different slope, more segments with varying slopes, a parabolic shape, etc. depending on the calibration.

FIG. 7 shows an exemplary look-up table 76 to be used when the trim position error is negative (i.e., target minus actual is negative) and the marine device 10 needs to be trimmed down to reach the target. Look-up table 76 also contains a plurality of calibrated raw on-times, wherein for example, a trim position error of −6% will return a raw on-time for the trim-in relay 34 of B seconds. FIG. 8 shows how even when the system is trimming the marine device 10 down, the raw on-time still increases as the magnitude of the trim position error increases. Note that the raw on-times for each of the trim-out and trim-in relays need not be the same given the same magnitude of trim position error. For example, the raw on-time C for an error of −4% need not necessarily be equal to A, the raw on-time for an error of 4%. The fact that differences may exist is shown by different slopes of the curves shown in FIGS. 6 and 8, as well as differences in where the slopes of each curve change. In other examples, the magnitude of the raw on-time is the same for a given magnitude of trim position error, regardless of the sign of the error.

The raw on-time values in the look-up tables 74, 76 (or other input-output maps) can be calibrated by testing individual trim systems and seeing how long a trim-in relay 34 or trim-out relay 36 must be provided with electricity in order to achieve a particular target trim position. The calibrated values will likely vary for outboards versus stern drives, and likely will vary based on whether the marine device 10 is being trimmed up or down. For example, for a given magnitude of error, a bit less relay on-time may be required to trim down to a target than to trim up to a target, because the trim actuator 16 must work against gravity in the latter instance. Generally, each calibrated on-time also depends on one or more of a time it takes a valve 41, 43 between the pump-motor combination 20 and the piston-cylinder assembly 18 to close, an amount of expansion of the first and second hydraulic lines 40, 42, and inertia of the pump-motor combination 20, as each of these things results in a delay between when the relay 34 or 36 is de-activated and movement of the trim actuator 16 ceases.

FIGS. 9-12 will now be used to show more detail regarding the step in box 412. FIG. 9 includes an exemplary look-up table 78 that accepts an acceleration rate as an input and outputs a calibrated multiplier for situations in which the trim error is positive. For example, at an acceleration rate of 0 $m/s^2$, the multiplier is D. In one example, D=1, such that at zero acceleration, the raw on-time calculated at box 410 (see FIGS. 5 and 6) is not scaled at all, but serves as the activation time for the trim-out relay 36. In fact, the on-time multiplier might be equal to 1 for acceleration rates having magnitudes within a given threshold of zero, thus creating a first deadband 80 within which a given acceleration rate does not result in scaling of the raw on-time. Outside of this first deadband 80, however, when the trim position error is positive, the on-time multiplier increases as the acceleration rate increases. See, for example, how in FIG. 10 the multiplier increases as the acceleration rate increases from −500 $m/s^2$ to −300 $m/s^2$ and as the acceleration rate increases from 300 $m/s^2$ to 500 $m/s^2$.

FIG. 11 shows an exemplary look-up table 82 that accepts a given acceleration rate as an input and outputs a calibrated multiplier for situations in which the trim error is negative. For example, at an acceleration rate of 300 $m/s^2$, the multiplier is E. Similar to the chart of FIG. 10, the chart in FIG. 12 shows how a second deadband 84 exists for the trim-down multiplier as well. Within this second deadband 84, the multiplier may be equal to 1, such that the raw on-time determined in box 410 is not scaled before being used as the activation time. FIG. 12 shows how when the trim position error is negative, the on-time multiplier increases as the acceleration rate decreases if the acceleration rate is outside of the second deadband 84. Note how the multiplier increases as the acceleration rate decreases from −300 $m/s^2$ to −500 $m/s^2$ and as the acceleration rate decreases from 500 $m/s^2$ to 300 $m/s^2$ The multiplier of FIGS. 9-12 is used to account for engine loading and predicted movement of the target trim position. For example, if the vessel 14 is accelerating and the target trim position is increasing (i.e., the trim position error is positive), a longer on-time for the trim-out relay 36 is required to account for the increasing target trim position as well as to account for an opposing load created by the thrust of the drive unit against the direction of the trim event. If the acceleration is relatively low (i.e., within the first deadband 80), the calibrated raw on-time value provides enough activation time to move the marine device 10 to the target position. However, if the vessel 14 is accelerating at a high rate (i.e., a rate above the first deadband 80), a multiplier will be needed to increase the activation time to account for the extra load created by the thrust of the drive unit. On the other hand, if the vessel 14 is decelerating, the target trim position is decreasing (i.e., the trim position error is negative) and a hydrodynamic load is pushing up on the drive unit due to the vessel 14 coasting down, which requires a longer on-time for the trim-in relay 34 to account for the decreasing trim target position and the opposing hydrodynamic load on the drive unit. If the deceleration rate is relatively low (i.e., within the second deadband 84) then the calibrated raw on-time provides enough activation time to move the marine device 10 to the target position. However, if the vessel 14 is decelerating at a high rate (i.e., a rate below the second deadband), a multiplier will be needed to increase the activation time to account for the extra hydrodynamic load on the drive unit as the vessel quickly slows. The multiplier is then used as such: ACTIVATION_TIME=RAW_ON-TIME*MULTIPLIER.

In other examples, the acceleration rate is not used to find a multiplier, but to find a number that is added to or subtracted from the raw on-time to find an activation time. In still other examples, both the multiplier and the raw on-time are combined into one large input-output map that accepts both trim position error and acceleration rate as inputs and outputs an activation time. Other types of equations or algorithms could be used instead of tables. In still other examples, there is no deadband 80 or 84, and every raw on-time is scaled somewhat regardless of the vessel's acceleration rate. Alternatively, enough calibrations may be done such that required on-times for each sign and magnitude of trim error at each sign and magnitude of acceleration rate are determined and used as activation times. Note that where a particular trim position error or acceleration rate is not found in a table or input-output map, a raw on-time or a multiplier can be calculated using interpolation (e.g., linear interpolation) between the values that are provided. Note also that if the marine device 10 is a trim tab or similar, the raw on-time calibrations are still relevant because they apply to trim system components, but will have values that depend on the particular trim tab system. The acceleration-based multiplier is not as relevant, however, seeing as acceleration of the vessel does not affect trim tab loading as much as acceleration affects drive unit loading (on, e.g., a stern drive or outboard drive).

Using a time-based open loop algorithm as described herein above allows the amount of inertia built up in the trim system to be controlled and can restrict the time that the relay 34 or 36 is energized enough that the respective check valve 41 or 43 cannot fully open, thereby preventing overshoot of the target during fine corrections. If only a feedback-based algorithm for coarse corrections (boxes 418-424, FIG. 4) were used for all magnitudes of trim error, the time required to make an adjustment as low as, for example, 0.5%, is so short that by the time the trim position sensor 62 begins to detect movement, the actual trim position can already be past the target trim position. Fine corrections are helpful during slight vessel accelerations and relatively steady-state driving because they do not require such position feedback to work. Fine corrections are also critical for vessels that do not have a very wide trim range, such as multi-engine offshore boats or racing applications, which only use between 10-15% of the trim range and/or where an over/under correction can induce undesired handling issues.

Figure 13:
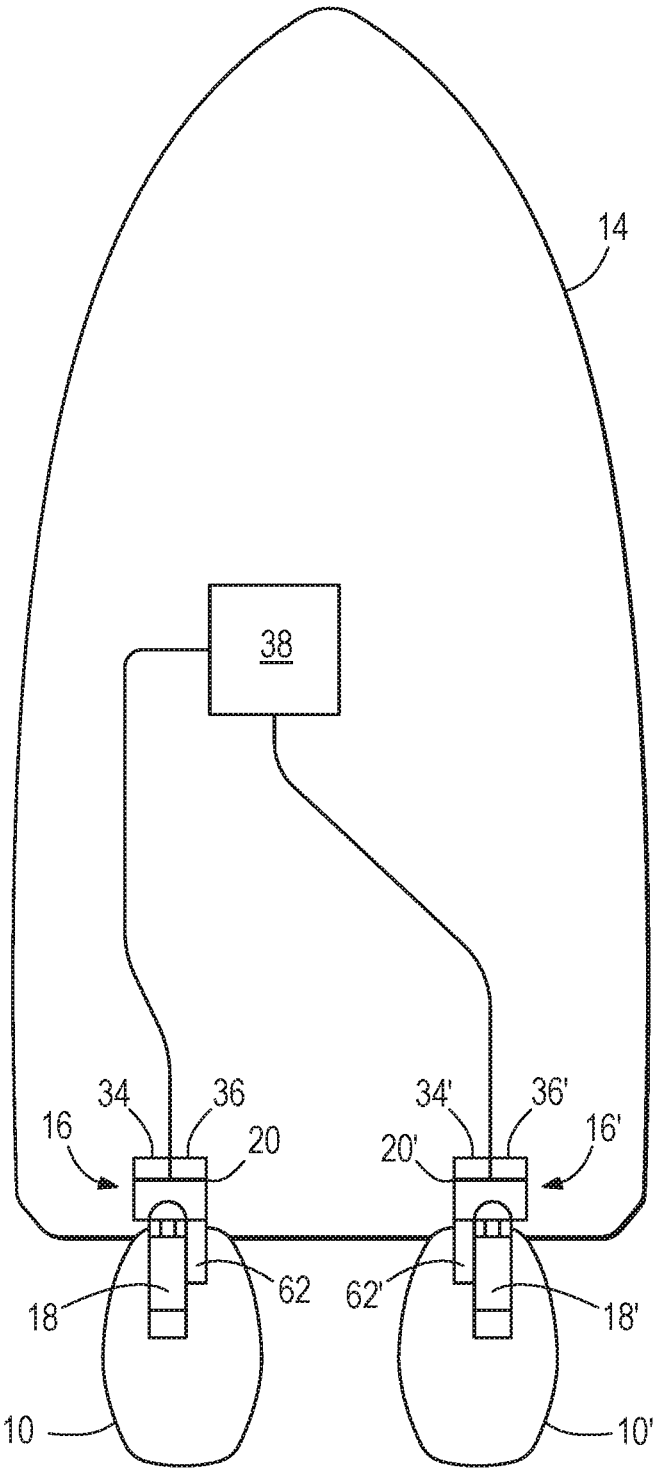
FIG. 13 illustrates a schematic of a marine vessel with two marine devices.

In another example, as shown in FIG. 13, there are two marine devices 10, 10' coupled to the marine vessel 14. The system shown in FIG. 13 is similar to that of FIG. 1 in that there is a controller 38 that determines target trim positions of the marine devices 10, 10' based on a condition of the marine vessel 14 (such as vessel speed), and there are trim position sensors 62, 62' that sense actual trim positions of the marine devices 10, 10' and send actual trim position information to the controller 38. Trim actuators 16, 16' (each including relays 34, 36, 34', 36') are coupled to the marine devices 10, 10' and configured to rotate the marine devices 10, 10' about horizontal trim axes in response to signals from the controller 38. The controller 38 determines magnitudes of trim position errors for each marine device 10, 10' by comparing the actual trim positions to the target trim positions. The controller 38 then determines activation times of the trim actuators 16, 16' based on the magnitudes of the trim position errors and sends control signals to the trim actuators 16, 16' to rotate the marine devices 10, 10' toward the target trim positions. The controller 38 discontinues the control signals once the activation times expire. (Note that although only two marine devices are shown in FIG. 13, the method described herein is applicable to more than two.)

Figure 14:
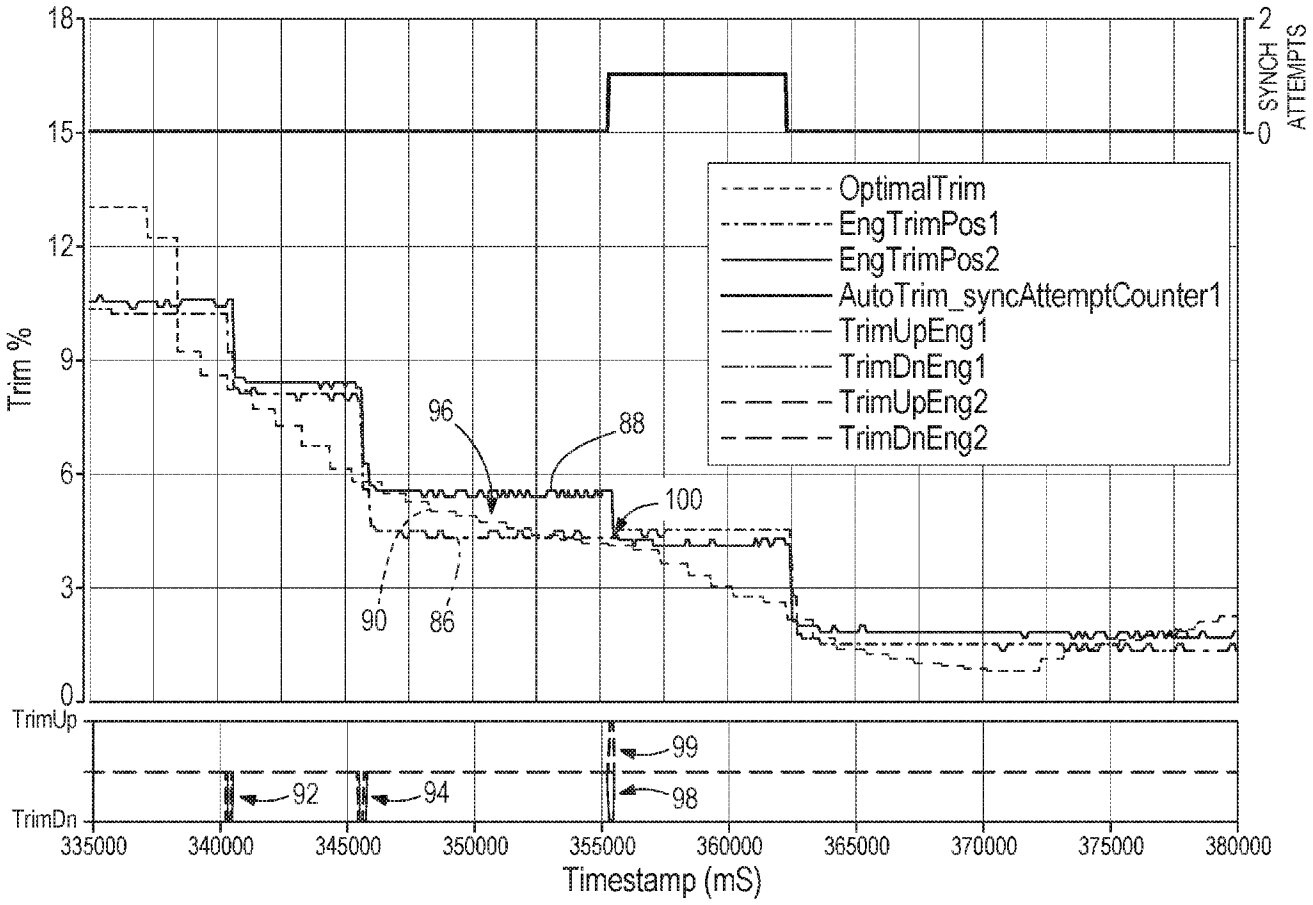
FIG. 14 is a chart showing an example of fine corrections being made to the trim positions of two marine devices.

Now referring to FIG. 14, an example of how fine corrections can be used to trim two or more marine devices 10, 10' to a sync position between the two devices' original positions when their positions vary from the sync position by more than a threshold (a "sync event") will be described. FIG. 14 is a chart showing activation of the trim-in relays 34, 34' and trim-out relays 36, 36' on a lower plot and trim position of the first and second marine devices on an upper plot with respect to time. The actual trim position of the first marine device 10 is shown at 86, while the actual trim position of the second marine device 10' is shown at 88. The target trim position for both the first and second marine devices 10, 10' is shown at 90. The vessel 14 whose behavior is being monitored is in this instance slowly decelerating, and thus the target trim position 90 is decreasing. It can be seen that activation pulses are sent to the trim relays at about 341000 mS and about 346000 mS. With the first pulses shown at 92, both the first and second marine devices 10, 10' have their trim-in relays 34, 34' activated for a calibrated amount of time to bring them down to the target trim position. With the second pulses 94, both marine devices 10, 10' are again trimmed down to the target. However, as shown by the behavior at 96, after about 34700 mS, the actual trim positions of the first and second marine devices 10, 10' vary from a sync position between the two devices' positions enough that a sync event is triggered. The controller 38 activates the trim-in relay 34 of the first marine device 10 as shown at pulse 98 and the trim-out relay 36' of the second marine device 10' as shown at pulse 99 to carry out the sync event.

Additionally, note that in area 96 the actual trim position of the first marine device 10 is above the sync position (which now serves as a target trim position), while the actual trim position of the second marine device 10' is below the sync position. This results in a look-up table 76 such as that in FIG. 7 being used to determine the raw on-time for the first marine device 10 and a look-up table 74 such as that in FIG. 5 being used to determine the raw on-time for the second marine device 10'. Additionally, the deceleration sides of the curves shown in FIGS. 10 and 12 will be used, as the table 82 of FIG. 11 will be used to determine the on-time multiplier for the first marine device's activation time and the table 78 of FIG. 9 will be used to determine the on-time multiplier for the second marine device's activation time. Thus, it is not always necessarily so that deceleration will result in trimming down and acceleration will result in trimming up, especially during a sync event. Note that the multiplier for the second marine device's activation time may in fact be less than 1 if the acceleration rate is less than the first deadband 80 (see FIG. 10), effectively resulting in scaling down the raw on-time. The multiplier for the first marine device's activation time may be greater than 1 if the acceleration rate is less that the second deadband 84 (see FIG. 12), effectively scaling up the raw on-time. This is reflected in that the second marine device 10' trims up less than the first marine device 10 trims down, as shown just after 100 in FIG. 14, even though both marine devices are being trimmed toward the sync position.

The controller 38 uses a "fine" correction algorithm to trim the marine devices 10, 10' to the sync position. If a coarse correction were instead used to sync the positions of the marine devices 10, 10' (see boxes 418-424, FIG. 4) this might cause both marine devices 10, 10' to overshoot the target trim position while the controller 38 waits for feedback on trim position from the trim position sensors 62, 62'. Thus, the fine correction using open loop control is instead used for sync events. Thus, in a multi-device application, a coarse or fine correction will be used for individual marine devices as necessary depending on each marine device's trim position error's magnitude. If a sync event is triggered, however, a fine correction will be used to trim each marine device 10, 10' toward the sync position for the calculated activation time.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. A method configured for controlling a trim system on a marine vessel, the method comprising:

receiving an actual trim position of a trimmable marine device at a controller;

determining a magnitude of a trim position error by comparing the actual trim position to a target trim position with the controller;

determining a magnitude of an acceleration rate of the marine vessel;

calculating a specified activation time of a trim actuator coupled to and rotating the marine device with respect to the marine vessel, wherein the controller calculates the specified activation time using inputs of the magnitude of the trim position error and the magnitude of the acceleration rate;

sending a control signal with the controller to activate the trim actuator to rotate the marine device toward the target trim position; and discontinuing the control signal in response to expiration of the specified activation time so as to deactivate the trim actuator.

2. The method of claim 1, further comprising comparing the magnitude of the trim position error to a first error threshold with the controller, and sending the control signal to activate the trim actuator only if the magnitude of the trim position error exceeds the first error threshold.

3. The method of claim 2, further comprising comparing the magnitude of the trim position error to a second error threshold having a greater magnitude than the first error threshold with the controller, and sending the control signal to activate the trim actuator only if the magnitude of the trim position error is less than the second error threshold.

4. The method of claim 1, further comprising:

determining a raw on-time based on the magnitude of the trim position error;

determining an on-time multiplier based on the magnitude of the acceleration rate; and multiplying the raw on-time by the on-time multiplier to calculate the specified activation time.

5. The method of claim 4, wherein the raw on-time increases as the magnitude of the trim position error increases.

6. The method of claim 4, wherein when the trim position error is positive, the on-time multiplier increases as the acceleration rate increases if the acceleration rate is outside of a first deadband.

7. The method of claim 6, wherein when the trim position error is negative, the on-time multiplier increases as the acceleration rate decreases if the acceleration rate is outside of a second deadband.

8. The method of claim 1, further comprising determining the target trim position with the controller based on vessel speed.

9. The method of claim 1, wherein the trim system is a hydraulic trim system and the marine device is an outboard motor coupled to the marine vessel.

10. The method of claim 1, further comprising sending the control signal to activate the trim actuator only after determining that a given period of time has elapsed since the trim actuator was last activated.

11. A system configured for controlling a trim position of a trimmable marine device with respect to a marine vessel, the system comprising:

a controller that determines a target trim position of the marine device based on a condition of the marine vessel;

a trim position sensor that senses an actual trim position of the marine device and sends actual trim position information to the controller; and a trim actuator coupled to the marine device and configured to rotate the marine device about a horizontal trim axis in response to signals from the controller;

wherein the controller determines a magnitude of a trim position error by comparing the actual trim position to the target trim position;

wherein the controller determines an activation time of the trim actuator based on the magnitude of the trim position error;

wherein the controller sends a control signal to the trim actuator to rotate the marine device toward the target trim position and discontinues the control signal once the activation time expires; and wherein the controller sends the control signal to activate the trim actuator only after determining that a given period of time has elapsed since the trim actuator was last activated.

12. The system of claim 11, wherein the trim actuator comprises:

a pump-motor combination activated by a relay;

a piston-cylinder assembly having a first end coupled to the marine vessel and a second end movable with respect to the first end and coupled to the marine device;

a first hydraulic line coupling the pump-motor combination to a first chamber at the first end of the piston-cylinder; and a second hydraulic line coupling the pump-motor combination to a second chamber at the second end of the piston-cylinder.

13. The system of claim 12, wherein the activation time is based at least in part on a calibrated on-time obtained from an input-output map that relates a plurality of trim position errors to a plurality of calibrated on-times.

14. The system of claim 13, wherein each on-time in the plurality of on-times depends on one or more of a time it takes a valve between the pump-motor combination and the piston-cylinder assembly to close, an amount of expansion of the first and second hydraulic lines, and inertia of the pump-motor combination.

15. The system of claim 13, wherein the controller determines a magnitude of an acceleration rate of the marine vessel and determines the activation time based also on the magnitude of the acceleration rate.

16. The system of claim 15, wherein the controller determines the activation time by multiplying the on-time corresponding to the trim position error by an on-time multiplier that varies depending on the magnitude of the acceleration rate.

17. The system of claim 16, wherein:

the on-time increases as the magnitude of the trim position error increases;

when the trim position error is positive, the on-time multiplier increases as the acceleration rate increases if the acceleration rate is outside of a first deadband; and when the trim position error is negative, the on-time multiplier increases as the acceleration rate decreases if the acceleration rate is outside of a second deadband.

18. The system of claim 11, wherein the controller determines the target trim position based on vessel speed.

19. The system of claim 11, wherein the marine device is an outboard motor.

* * * * *